US009752392B2

(12) United States Patent
Semple et al.

(10) Patent No.: US 9,752,392 B2
(45) Date of Patent: Sep. 5, 2017

(54) NECK CLAMP FOR ELECTRICAL SUBMERSIBLE PUMP AND METHOD OF INSTALLATION

(71) Applicant: Baker Hughes Incorporated, Houston, TX (US)

(72) Inventors: Ryan P. Semple, Owasso, OK (US); Jason E. Hill, Catoosa, OK (US); Adam M. Henderson, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 475 days.

(21) Appl. No.: 14/341,352

(22) Filed: Jul. 25, 2014

(65) Prior Publication Data

US 2016/0024860 A1 Jan. 28, 2016

(51) Int. Cl.
*E21B 17/10* (2006.01)
*E21B 43/12* (2006.01)

(52) U.S. Cl.
CPC ..... *E21B 17/1035* (2013.01); *E21B 43/128* (2013.01)

(58) Field of Classification Search
CPC .. E21B 17/1085; E21B 43/128; E21B 34/066; E21B 43/26; E21B 43/2405
See application file for complete search history.

(56) References Cited

U.S. PATENT DOCUMENTS

| | | | | |
|---|---|---|---|---|
| 2,233,890 | A | 3/1941 | Hoover | |
| 3,390,371 | A | 6/1968 | Kramer | |
| 4,060,345 | A | 11/1977 | Blum | |
| 4,154,302 | A | 5/1979 | Cugini | |
| 4,627,490 | A | 12/1986 | Moore | |
| 4,708,201 | A | 11/1987 | Reed | |
| 4,728,296 | A | 3/1988 | Stamm | |
| 5,343,942 | A | 9/1994 | Serra et al. | |
| 5,380,158 | A | 1/1995 | Gerbitz | |
| 6,557,905 | B2 | 5/2003 | Mack et al. | |
| 2009/0053080 | A1 * | 2/2009 | Ives | F04D 29/628 417/410.1 |
| 2013/0340245 | A1 | 12/2013 | Watson et al. | |

FOREIGN PATENT DOCUMENTS

| | | | | |
|---|---|---|---|---|
| VG | GB 2430701 A | * | 4/2007 | E21B 17/026 |

* cited by examiner

*Primary Examiner* — Cathleen Hutchins
*Assistant Examiner* — Ronald Runyan
(74) *Attorney, Agent, or Firm* — Bracewell LLP; James E. Bradley

(57) ABSTRACT

A well pump assembly has a number modules, including a pump and a motor, secured together. Each of the modules has a housing, and at least one of the modules has a neck of reduced diameter relative to the housing. A clamp is secured around the neck. The clamp has a dovetail groove extending around and within the outer surface of the clamp. An accessory member protrudes radially outward from the outer surface of the clamp and has an inner portion located in the groove. A threaded fastener secures the accessory member to the clamp. The accessory member is slidable along the groove to a selected orientation prior to tightening the fastener.

20 Claims, 5 Drawing Sheets

NECK CLAMP FOR ELECTRICAL SUBMERSIBLE PUMP AND METHOD OF INSTALLATION

FIELD OF THE DISCLOSURE

This disclosure relates in general to devices secured to an electrical submersible pump assembly to protect external electrical and hydraulic lines that extend alongside the electrical submersible pump assembly.

BACKGROUND

Electrical submersible pumps (ESP) are commonly used in wells for hydrocarbon fluid production. An ESP is made up of a number of modules brought to the well site. These modules include a pump, a motor, and a seal section or pressure equalizer. The modules may also include a gas separator. Additionally, the pump and motor may comprise tandem units that are connected at the well site. The connections between the various modules are often smaller in diameter than the remaining portions of the modules. These connections may be bolted flanges or they may comprise threaded collars. When installing the ESP, a motor lead and possibly other lines, are attached by banding alongside portions of the ESP.

It is important to keep the motor lead and the other lines in a straight line parallel to the axis of the ESP. If the motor lead and other lines curve helically around the ESP, a chance exists that the ESP could become stuck while lowering the ESP into the well. Because of the length of the ESP, a lower portion of the motor lead and other lines may not be visible while banding upper portions of the motor lead and lines to the ESP. Maintaining the motor lead and accessory lines straight can be difficult.

Also, the connections between the various modules normally result in an area of reduced diameter along the ESP. As well fluid flows upward past the motor to the pump intake, it will encounter at least one the reduced diameter area above the motor before reaching the pump intake. Turbulence may result, which may cause wear and erosion of the housings at the reduced diameter area.

The threaded collar type of connection between modules employs an internally threaded collar that fits around a neck of one of the modules. The collar has an axial width that is less than the length of the neck so that the motor shafts within the adjoining modules can be stabbed together before the collar is made up. A risk exists that the collar will loosen and drop down to the base of the neck due to vibration of the ESP during operation. If so, the modules would become disconnected from each other.

SUMMARY

The well pump of this disclosure includes a plurality of modules, including a pump and a motor, secured together. Each of the modules has a housing, and at least one of the modules has a neck of reduced diameter relative to the housing. A clamp secures around the neck, the clamp having a recess on its outer surface. At least one accessary member is secured into the recess and protrudes radially outward from the clamp. The recess defines a plurality of selective angular positions in a plane perpendicular to the axis for securing the accessary member.

Preferably, the recess is elongated and extends a selected circumferential distance around the outer surface of the clamp. In the embodiments shown, the recess extends completely around a circumference of the outer surface. The recess comprises a groove having at least one wall surface facing inward toward the axis. The recess may have a dovetail configuration.

In the example shown, the accessary member has a retainer portion located within the groove and a threaded fastener. The accessary member and the retainer portion are slidable along the groove to a selected angular position prior to tightening the fastener. Tightening the fastener pulls the retainer portion outward into frictional engagement with the wall surface, thereby locking the accessary member in the selected angular position.

The accessary member may comprise a clip having an opening for receiving a line extending alongside the pump assembly. The accessary member may also comprise a standoff for positioning the pump assembly away from a wall of the well.

In one embodiment, the neck protrudes from a first module and extends to a second module. A collar is carried and retained on the neck and in threaded engagement with the second module, thereby securing the first module to the second module. The collar has an axial dimension less than a length of the neck. The clamp is secured around the neck and fills a space between the collar and the first module to prevent the collar from disengaging from the second module.

In another embodiment, a shroud surrounds the clamp and an entire extent of the neck. The accessary member protrudes radially outward from the shroud.

DETAILED DESCRIPTION OF THE DISCLOSURE

Figure 1:
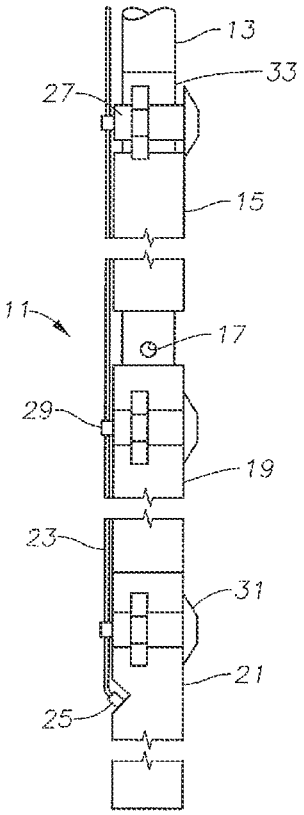
FIG. 1 is a side view of an electrical submersible pump assembly having protection clamps in accordance with this disclosure.

Referring to FIG. 1, an electrical submersible pump (ESP) 11 is suspended on a string of production tubing 13. Production tubing 13 may comprises separate sections of pipe screwed together by threads; alternately, it could comprise continuous coiled tubing. ESP 11 is normally submersed in either a vertical, inclined, or horizontal portion of a well. The well fluid being pumped may flow up tubing 13 or in the annular space around it.

ESP 11 is made up of several modules, including a pump 15, which may be a centrifugal pump made up of a large number of stages, each stage having an impeller and a diffuser. Alternately, pump 15 could be another type, such as a progressing cavity pump. Pump 15 has an intake 17 for drawing in well fluid. Intake 17 may be in a separate module. Another module comprises a seal section or pressure equalizer 19, which attaches to the lower end of intake 17. The terms "upper", "lower" and the like are used only for convenience, because ESP 11 may be oriented other than vertically.

Another module comprises a motor 21, which attaches to the lower end of seal section 19. Motor 21 is typically a three-phase motor filled with a dielectric lubricant. Seal section 19 contains dielectric lubricant that communicates with the dielectric lubricant in motor 21 to reduce a pressure differential between the internal pressure within motor 21 and the hydrostatic pressure of the well fluid on the exterior of ESP 11. Although shown above, seal section 19 could be mounted below motor 21. If located above, seal section 19 may also have a thrust bearing for absorbing down thrust generated by pump 15, or the thrust bearing may be in a separate module. A motor lead 23 extends alongside a lower portion of tubing 13, pump 15, and seal section 19 to an electrical connector 25 near the upper end of motor 21. Motor lead 23 connects to a power cable (not shown) that extends to a wellhead for supplying electrical power to motor 21.

ESP 11 may include a sensor or gauge unit (not shown), normally mounted at the bottom of motor 21. An instrument wire (not shown) could be incorporated in motor lead 23 and in the power cable or it could be separate from motor lead 23. Optionally, the instrument wire extends alongside motor 21 to the sensor. Other lines, in addition to electrical lines, may extend alongside ESP 11, such as hydraulic fluid lines and lines for delivering chemicals, ESP 11 may have other modules, such as a gas separator (not shown) located below pump 15. If so, intake 17 would be at the lower end of the gas separator. Further, more than one pump 15, more than one seal section 19 and more than one motor 21 could be employed in tandem in ESP 11. Normally, the various modules are brought to the well site apart from each other, then connected at the well site.

ESP 11 includes a plurality of clamps 27 (three illustrated), each located at an end of one of the modules. Various accessary members may be mounted to each clamps 27, the accessary members including clips 29 and standoffs or centralizers 31. Clips 29 retain motor lead 23 and optionally an instrument wire alongside ESP 11. Clips 29 could also retain other control lines, chemical injection lines and hydraulic lines. Standoffs 31 push ESP 11 away from a wall of the well casing (not shown). Each standoff 31 extends radially past the outer diameter of ESP 11. Standoffs 31 may have tapered upper and lower ends, as shown.

Figure 2:
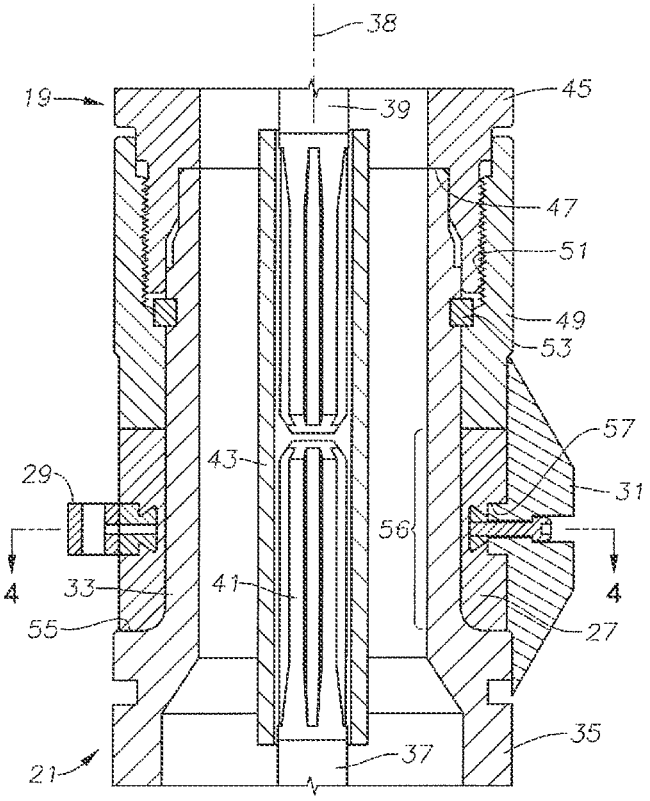
FIG. 2 is an enlarged sectional view of one of the protection clamps of FIG. 1.

The connections between the modules normally have a reduced diameter portion of lesser diameter, referred to herein as a neck 33, than the modules being connected. Clamps 27 are preferably mounted to one or more of necks 33. There are at least two techniques known for connecting the modules, one of which is illustrated in FIG. 2 and the other in FIG. 8. Referring to FIG. 2, which may be considered to be a threaded collar type of connection, neck 33 has a base 35 that is of larger diameter and which has external threads (not shown) on its lower end that screw into internal threads of a housing of one of the modules. As an example, neck 33 secures into the upper end of the housing of motor 21 (FIG. 1). A motor shaft 37 for driving pump 15 (FIG. 1) extends into neck 33 along an axis 38 of ESP 11. A seal section shaft 39 extends from seal section 19 into neck 33. Shafts 37, 39 have splined ends 41 that abut each other. A coupling sleeve 43 surrounds and joins splined ends 41 for torque transmission, causing rotation of motor shaft 37 to rotate seal section shaft 39.

Seal section 19 has a housing portion 45 with a downward facing shoulder 47 that engages the rim of neck 33. Texturing, ribs or other anti-rotation features may be on shoulder 47 and the rim of neck 33 to prevent rotation of seal section 19 relative to neck 33. A cylindrical collar 49 fits around neck 33 and has internal threads 51 that engage external threads formed on seal section housing 45. Collar 49 has an internal shoulder that bears against a shoulder ring 53 located in an annular recess on the exterior of neck 33. Shoulder ring 53 may be a split ring. Neck 33 has an upward facing shoulder 55 at a junction between base 35 and the smaller diameter portion of neck 33. A gap 56 around neck 33 exists between shoulder 55 and the lower side of collar 49. Gap 56 enables splined shaft ends 41 to be stabbed into each other before collar 49 is brought upward into engagement with the threads on seal section housing 45.

Clamp 27 has an axial dimension or width that is approximately the same as gap 56 to completely fill gap 56 when installed. Clamp 27 has a thickness approximately equal to the difference in diameter between neck base 35 and the smaller diameter portion of neck 33. The outer diameter of clamp 27 is flush with the outer diameter of seal section housing 45 and the housing of motor 21.

Figure 3:
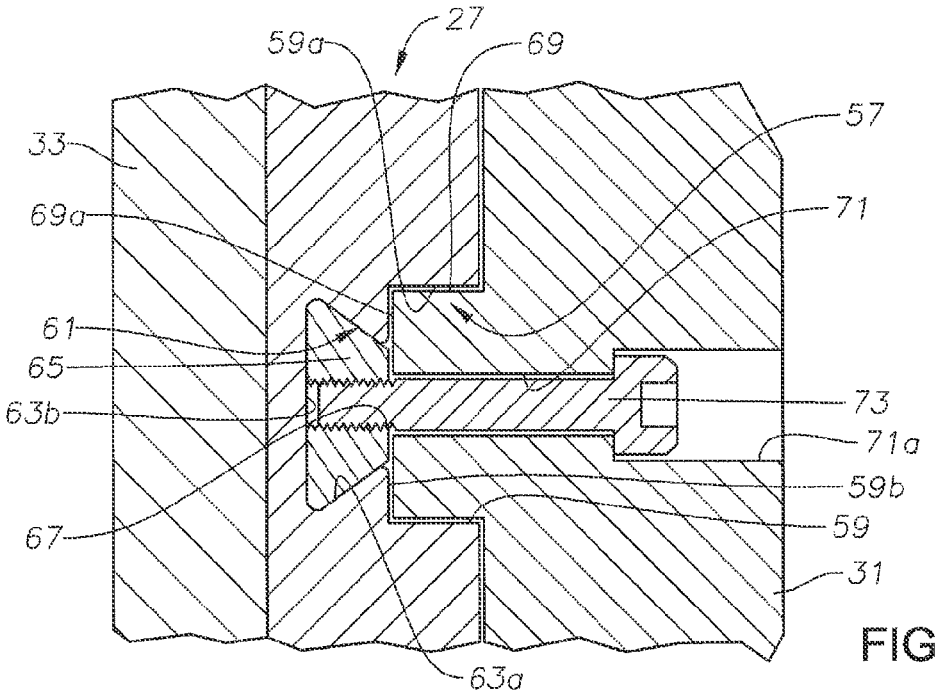
FIG. 3 is an enlarged view of a portion of the protection clamp of FIG. 2.

Referring to FIG. 3, a recess or groove 57 extends a selected circumferential distance around the outer surface of clamp 27. In the embodiments shown, the circumferential distance is a full 360 degrees. Groove 57 has an outer portion 59 that joins the outer surface of clamp 27 and an inner portion 61 that joins outer portion 59. Groove outer portion 59 has upper and lower surfaces 59*a* that are parallel to each other and perpendicular to axis 38 (FIG. 2). Groove outer portion 59 has upper and lower outward facing cylindrical walls 59*b*. Groove inner portion 61 has upper and lower inclined wall surfaces 63*a* that join cylindrical walls 59*b*, face generally inward, and extend inward to a cylindrical inner wall 63*b*. Inclined wall surfaces 63*a* and cylindrical inner wall 63 *b* provide groove inner portion 61 with a dovetail configuration. Groove outer portion 59 is rectangular when viewed in the axial cross section of FIG. 3.

Each accessary member 29, 31 includes a retainer 65 having the same axial cross-sectional configuration as groove inner portion 61 and which fits within groove inner portion 61. Retainer 65 has one or more threaded sockets 67 extending radially from an inner surface of retainer 65 to an outer surface of retainer 65. Retainer 65 has a circumferentially extending dimension that extends circumferentially a variable amount that is normally less than 90 degrees, for example 20 degrees.

In this example, standoff 31 has a rib 69 on its inner side that protrudes into recess outer portion 59. Rib 69 may be approximately centered between upper and lower edges of standoff 31. Rib 69 has a vertical dimension or thickness approximately equal to the distance between groove outer portion upper and lower surfaces 59*a*. Rib 69 has a radial dimension slightly less than the radial depth of groove outer portion 59, such that an inner wall 69*a* of rib 69 is spaced a slight distance outward from groove outer portion cylindrical wall 59*b*. Rib 69 extends circumferentially a variable amount that is normally less than 90 degrees, such as 20 degrees. The circumferential dimension of rib 69 may be about the same as that of retainer 65 or it may be more or less. Standoff 31 has one or more bores 71 extending radially through rib 69 that register with threaded sockets 67. Each bore 71 may have a counterbore 71*a* on its outer portion.

A bolt or fastener 73 extends through bore 71 into threaded engagement with socket 67 to secure standoff 31 to retainer 65. Before tightening fasteners 73, a worker can slide retainer 65 and standoff 31 to a desired position along the length of groove 57. Once tightened, retainer 65 will be pulled into tight frictional engagement with inclined wall surfaces 63*a* to lock standoff 31 in a desired angular position. When fully tightened, a small clearance will exist between inner wall 69*a* of rib 69 and outer portion cylindrical walls 59*b*. Also, a small clearance will exist between the inner wall 69*a* of rib 69 and the outer wall of retainer 65.

Figure 4:
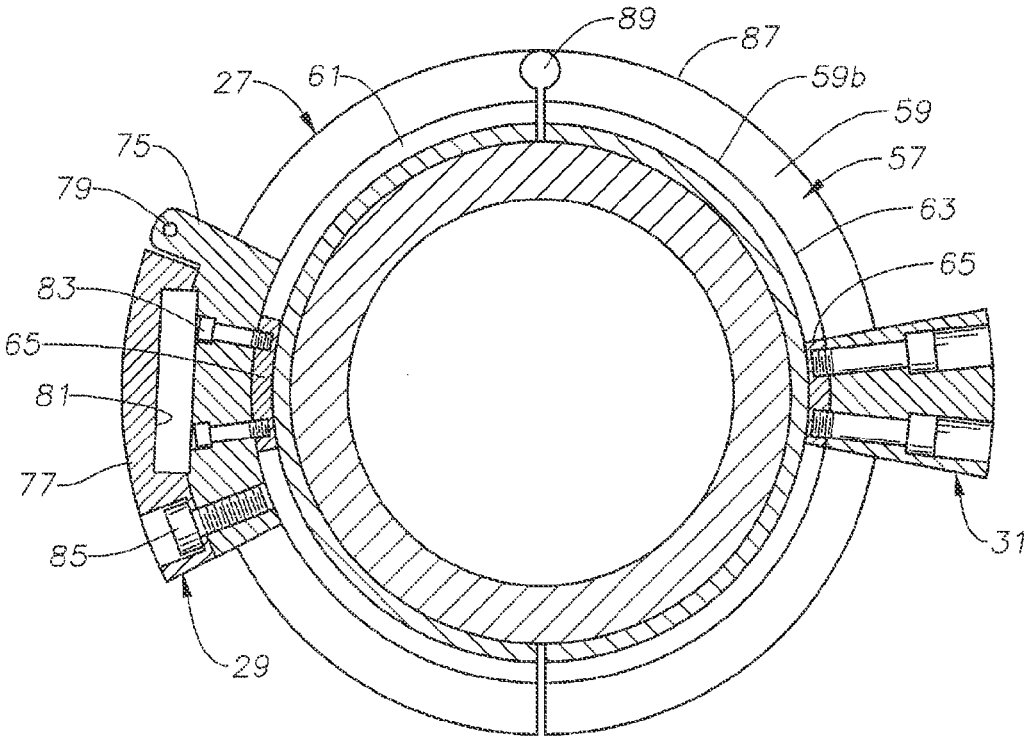
FIG. 4 is a sectional view of the protection clamp, taken along the line 4-4 of FIG. 2.

Referring to FIG. 4, clip 29 fastens to clamp 27 in a similar manner, employing the same groove 57. The retainer 65 of clip 29 may be identical to retainer 65 of standoff 31. Clip 29 may have a variety of configurations. In this example, clip 29 has a base 75 that extends into groove outer portion 59. A clasp 77 is secured to clip base 75 by a hinge 79 and is movable between the closed position shown and an open position. Base 79 and clasp 77 define an aperture 81 between them into which motor lead 23 (FIG. 1) or other lines are inserted. When clasp 77 opens, aperture 81 opens to position the lines within. Retainer fasteners 83 extend through holes in clip base 79 into threaded sockets 67 of retainer 65. A fastener 85 for clasp 77 may comprises a threaded bolt. Clip 29 may extend a variable amount circumferentially. In the example shown, each clip 29 has a circumferential extent of about 45 degrees, which is greater than retainer 65.

Referring still to FIG. 4, clamp 27 comprises two semi-cylindrical halves 87 connected by a hinge 89. Various means may be employed to secure clamp halves 87 in a circular configuration. For example, an over center clasp (not shown) on one of the clamp halves 87 could be employed for engaging a shoulder on the other. Also, threaded fasteners (not shown) could be used to secured clamps halves 87 in a closed position. The inner diameter of clamp 27 is selected so that when secured and closed, clamp 27 tightly grips neck 33.

Figure 5:
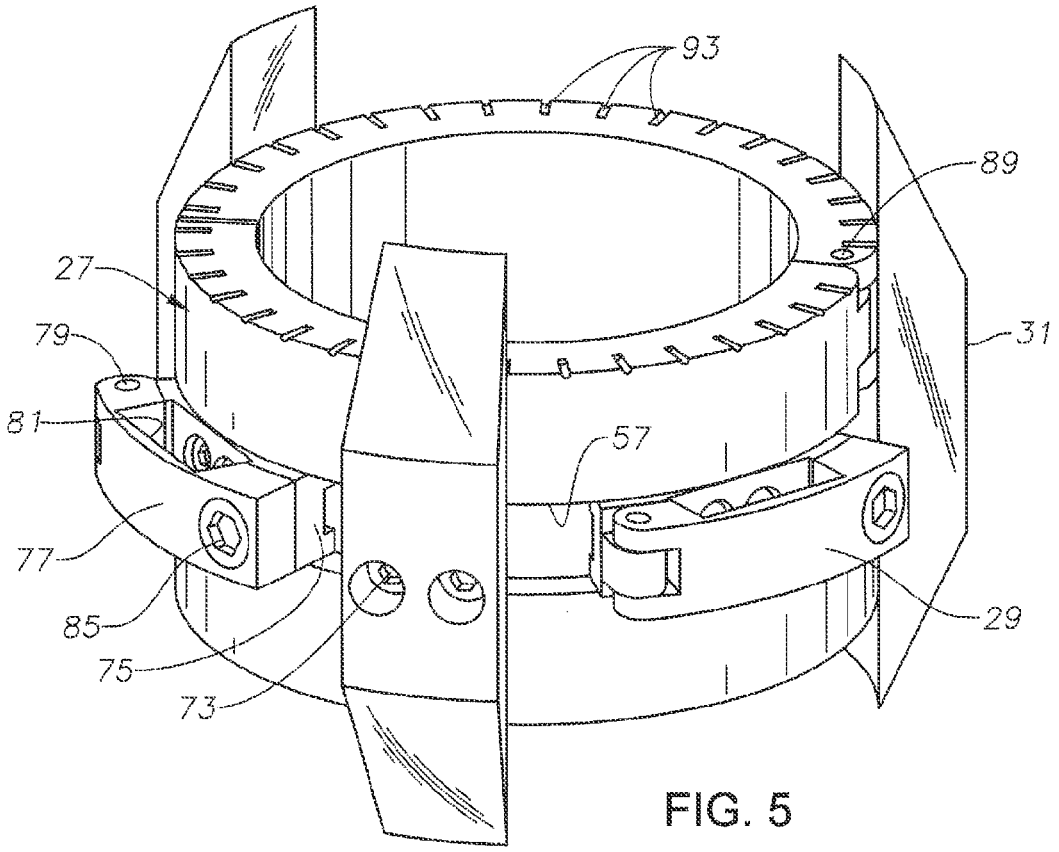
FIG. 5 is a perspective view of the clamp of FIG. 2, shown in a closed position detached from the submersible pump assembly.
Figure 6:
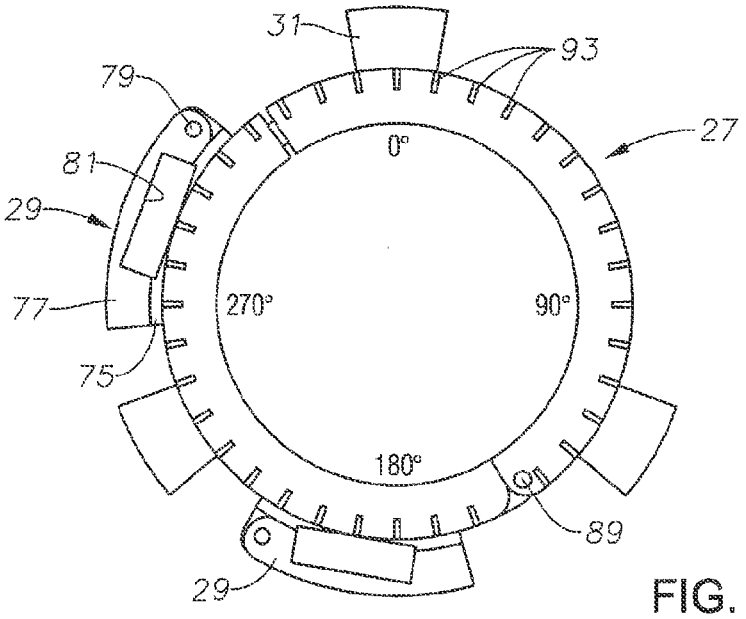
FIG. 6 is a top view of the protection clamp of FIG. 2, shown detached from the pump assembly.

Referring to FIGS. 5 and 6, indicia 93 may be formed on clamp 27, such as on the upper side, to designate angular locations around clamp 27 for placement of accessary members 29, 31. FIG. 6 shows three standoffs 31 positioned at 0 degrees, 120 degrees and 240 degrees. One clip 29 is located about 320 degrees and the other about 190 degrees. In some instances, an operator may want ESP 11 to be offset from the centerline of the well. In that instance, the operator may employ only one or two standoffs 31. Alternately, one of the standoffs 31 could protrude radially beyond clamp 27 more than others.

Figure 7:
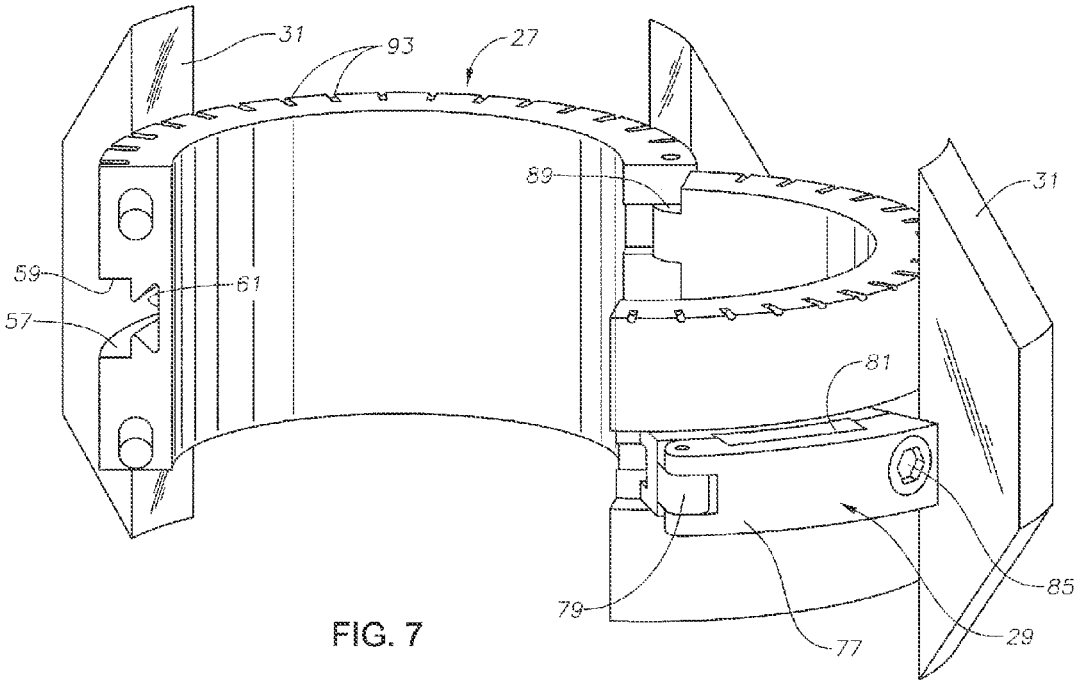
FIG. 7 is a perspective view of the protection clamp of FIG. 2, shown in an open position detached from the pump assembly.

Referring to FIG. 7, groove 57 extends completely to the end of each clamp half 87. Consequently, when clamps halves 87 are open, as shown in FIG. 7, a worker at the well site may pre-assemble clamps 27 before attaching them to ESP 11. The worker inserts retainers 65 into the open ends of groove 57 and slides retainers 65 along groove 57 to the desired orientation, according to indicia 93. Clips 29 and standoffs 31 are preferably loosely attached to their retainers 65 with fasteners 83, 73 prior to inserting their retainers 65 into groove 57. After being positioned in the desired location, fasteners 83 and 73 are tightened to secure clips 29 and standoffs 31 in the desired angular position. The final positioning and tightening may occur after clamps 27 are attached to necks 33.

It is important that clips 29 for motor lead 23 (FIG. 1) maintain motor lead 23 in a straight line, as well as other wires and lines, rather than curving helically around ESP 11. Because of the length of many ESPs 11, during installation, some of the clamps 27 may be out of sight within the well while others are still being assembled above the well. The operator can use indicia 93 to verify alignment. Pre-machined indicator features could be inscribed on the head and base of the ESP module, each of which secures by threads to a tubular housing of the module. For example, a pre-machined indicator mark at 90 degrees to the electrical connector 25 on motor 21 (FIG. 1) could be made, as well as a mark made on the base of motor 21. When the head and base are screwed to the housing of motor 21 at the factory, there will be an angular offset between the marks at the opposite end of the two parts. The angular offset could be checked with a laser and a sticker or label temporally attached to indicate the offset. At the field, clamps 27 could be oriented to compensate for the offset and assure that the clips 29 are aligned along a straight line parallel with axis 38.

During installation of ESP 11, motor 21 may be lowered a short distance into the well, placing the upper end of motor 21 above the well for connecting seal section 19. With the collar type connection illustrated in FIG. 2, the workers first stab splined ends 41 into engagement, then lift and tighten threaded collar 49. Motor lead 23 is plugged into motor 21. Gap 56 will be present between collar 49 and shoulder 55. Workers will then install one of the clamps 27 around neck 33 in gap 56. The worker may adjust the angular orientation of clips 29 by loosening fasteners 83, sliding clips 29 to a new position, then re-tightening fasteners 83. The positions of standoffs 31 can also be adjusted in the same manner. The worker will open clip clasp 77 (FIG. 4), place motor lead 23 within aperture 81, and optionally place any other lines within other clips 29.

Then, motor 21 and seal section 19 are lowered further in the well, placing the upper end of seal section 19 above the well for connecting pump 15. The process of connecting one of the clamps 27 is repeated. After all the modules of the entire ESP 11 are connected, it is lowered as a unit on production tubing 13 to a desired depth in the well.

During operation of ESP 11, well fluid flowing upward past motor 21 to intake 17 will be less likely to undergo turbulence as it flows past the connection between motor 21 and seal section 19 than if clamp 27 was not present. Each clamp 27 in the fluid flow eliminates an abrupt change in diameter of ESP 11 by completely covering gap 56. Also, each clamp 27 serves as a back up to prevent collar 49 from loosening due to vibration. Even if collar 49 loosens, it will be stopped from completely disengaging because of its abutment with clamp 27.

Figure 8:
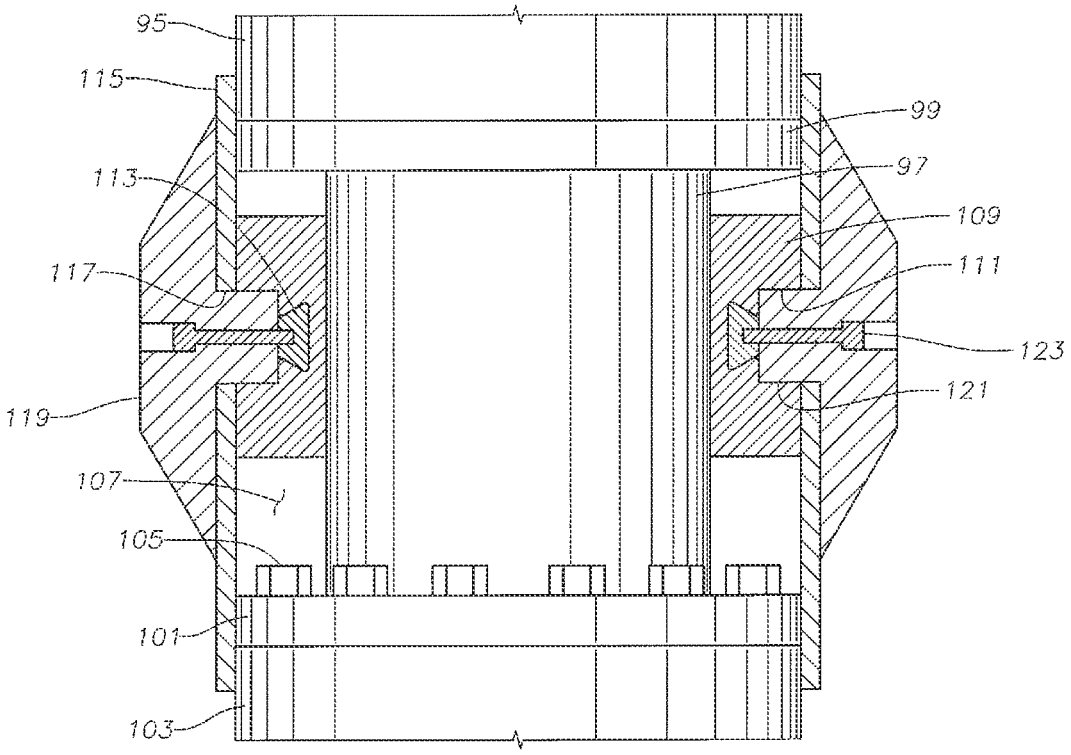
FIG. 8 is an alternate embodiment of the protection clamp of FIG. 2, shown with a protective shroud.

FIG. 8 illustrates a bolted type of connector between modules of ESP 11. Seal section housing 95 has a neck 97 extending downward from it. Neck 97 has an upper externally threaded section (not shown) that secures to internal threads in seal section housing 95. An upper flange 99 on neck 97 abuts the lower end of the seal section housing 95. Neck 97 has a lower flange 101 that bolts to the upper end of motor housing 103 with bolts 105. Neck 97 has a smaller outer diameter than either housing 95, 103, creating a discontinuity in diameter or gap 107 along the length of ESP 11.

A clamp 109, which may be identical to clamps 27 (FIGS. 1-7), is secured to neck 97. Clamp 109 need not have an axial width equal to the axial width of gap 107, and it may be considerably smaller. Clamp 109 has an annular groove 111 that carries one or more retainers 113. In this embodiment, a shroud 115 slides over clamp 109 to completely enclose gap 107. Shroud 115 has an inner diameter slightly larger than the outer diameter of seal section housing 95 and motor housing 103 so that it can be positioned below gap 107 before seal section 95 is attached, then moved up. Shroud 115 has a plurality of windows 117 spaced around its circumference, one for each standoff 119 to be employed.

Each standoff 119 has a rib 121 that inserts through one of the windows 111 and registers with one of the retainers 113. The worker inserts fasteners 123 through standoff 119 into retainer 113 to secure standoff 119. The inner side of standoff 119 will be in abutment with the outer diameter of shroud 115.

During installation, shroud 115 will be placed around motor housing 103. The worker connects neck 97 to motor housing 103 with bolts 105. The worker slides retainers 113 to desired angular orientations. The worker then connects clamp 109 to neck 97 at a point that will place the upper edge of shroud 115 around seal section housing 95 and the lower edge around motor housing 103. The worker then slides shroud 103 up and rotates shroud 103 until its windows 117 align with retainers 113. The worker then inserts standoff ribs 121 into windows 117 and into groove 111. The worker then inserts fasteners 123 and tightens them.

While the pump is operating, shroud 115 will provide a smooth annular surface for fluid flowing upward along motor housing 103 to the pump intake. The smooth annular surface reduces turbulence, which can erode portions of motor housing 103 and seal section housing 95.

While the disclosure has been shown in only two of its forms, it should be apparent to those skilled in the art that it is not so limited but is susceptible to various changes without departing from the scope of the disclosure.

The invention claimed is:

1. A well pump assembly, comprising:

a plurality of modules, including a pump and a motor, secured together, each of the modules having a housing, at least one of the modules having a neck of reduced diameter relative to the housing of said at least one of the modules;

a clamp secured around the neck, the clamp having an axis and an outer surface surrounding the axis;

an elongated recess extending a selected circumferential distance around the outer surface;

at least one accessory member having an inner portion inserted into the recess, the accessory member protruding radially outward from the clamp and having a circumferential width less than 360 degrees; wherein the accessory member is slidable along the recess to a selected angular position; and a fastener secures the accessory member in the selected angular position.

2. The assembly according to claim 1, wherein the inner portion of the accessory member comprises a separate retainer from an outer portion of the accessory member, and the fastener secures the retainer to the outer portion of the accessory member.

3. The assembly according to claim 1, wherein the recess extends completely around a circumference of the outer surface.

4. The assembly according to claim 1, wherein:

the recess comprises a groove having at least one wall surface facing inward toward the axis;

the inner portion of the accessory member comprises a retainer portion separate from an outer portion of the accessory member;

the fastener is a threaded member that secures the outer portion of the accessory member to the retainer portion; and tightening the fastener pulls the retainer portion outward into frictional engagement with the wall surface, thereby locking the accessory member in the selected angular position.

5. The assembly according to claim 1, wherein:

the recess comprises a dovetail groove in which the inner portion of the accessory member is located.

6. The assembly according to claim 1, wherein:

the recess comprises a groove;

the groove has an outer portion and an inner portion radially inward from the outer portion and separated from the outer portion by an outward facing wall surface;

the inner portion of the accessory member comprises a retainer carried within the inner portion of the groove, the retainer having a threaded socket and being separate from an outer portion of the accessory member;

the accessory member has a rib extending into the outer portion of the groove;

the fastener extends through the rib of the accessory member into the socket of the retainer to secure the outer portion of the accessory member to the retainer; and wherein tightening the fastener pulls the rib inward against the outward facing wall surface to secure the accessory member in the selected position.

7. The assembly according to claim 1, wherein the accessory member comprises a clip having an opening for receiving a line extending alongside the pump assembly.

8. The assembly according to claim 1, wherein the accessory member comprises a standoff for positioning the pump assembly away from a wall of the well.

9. The assembly according to claim 1, wherein:

the neck joins another of the modules, defining a reduced diameter area between the at least one of the modules and the another of the modules; and wherein the assembly further comprises:

a shroud surrounding the clamp and an entire extent of the neck; and wherein the accessory member protrudes radially outward from the shroud.

10. A well pump assembly, comprising:

a plurality of modules, including a pump and a motor, secured together, each of the modules having a housing, at least one of the modules having a neck of reduced diameter relative to the housing of said at least one of the modules;

a clamp secured around the neck, the clamp having an axis and an outer surface surrounding the axis;

a recess on the outer surface;

at least one accessory member secured into the recess and protruding radially outward from the clamp; wherein the recess defines a plurality of selective angular position in a plane perpendicular to the axis for securing the accessory member;

the neck protrudes from a first one of the modules and extends to a second one of the modules, and the assembly further comprises:

a collar carried and retained on the neck and in threaded engagement with the second one of the modules, thereby securing the first one of the modules to the second one of the modules, the collar having an axial dimension less than a length of the neck; and the clamp is secured around the neck, filling a space between the collar and the first one of the modules when the collar is in threaded engagement with the second one of the modules, thereby preventing the collar from disengaging from the second one of the modules.

11. A well pump assembly, comprising:

a plurality of modules, including a pump and a motor, secured together, each of the modules having a housing, at least one of the modules having a neck of reduced diameter relative to the housing of said at least one of the modules;

a clamp secured around the neck, the clamp having an axis and an outer surface surrounding the axis;

a dovetail groove extending around and within the outer surface of the clamp;

an accessory member protruding radially outward from the outer surface of the clamp and having an inner portion located in the groove;

a threaded fastener that secures the accessory member to the clamp; and wherein the accessory member is slidable along the groove to a selected orientation prior to tightening the fastener.

12. The assembly according to claim 11, wherein:

the groove has an inner portion and an outer portion separated by an inward facing wall surface;

the accessory member has a rib that fits within the outer portion of the groove;

the accessory member has a retainer that fits within the inner portion of the groove, and the fastener extends through the rib between an outer portion of the accessory member and the retainer; and tightening the fastener draws the retainer into frictional engagement with the wall surface.

13. The assembly according to claim 11, wherein the accessory member comprises a clip having an opening for receiving therethrough a line extending alongside the pump assembly.

14. The assembly according to claim 11, wherein the accessory member comprises a standoff for positioning the pump assembly away from a wall of the well.

15. The assembly according to claim 11, wherein:

the neck protrudes from a first one of the modules and extends to a second one of the modules, and the assembly further comprises:

a collar carried and retained on the neck and in threaded engagement with the second one of the modules, thereby securing the first one of the modules to the second one of the modules, the collar having an axial dimension less than a length of the neck; and the clamp is secured around the neck, filling a space between the collar and the first one of the modules when the collar is in threaded engagement with the second one of the modules, thereby preventing the collar from disengaging from the second one of the modules.

16. The assembly according to claim 11, wherein:

the neck joins another of the modules, defining a reduced diameter area between the at least one of the modules and the another of the modules; and wherein the assembly further comprises:

a shroud surrounding the clamp and an entire extent of the neck; and wherein the accessory member protrudes radially outward from the shroud.

17. A method of installing a submersible pump assembly in a well, the pump assembly having a plurality of modules, including a pump and a motor, secured together, each of the modules having a housing, at least one of the modules having a neck of reduced diameter relative to the housing of said at least one of the modules, the method comprising:

providing a clamp with an axis, an outer surface surrounding the axis, and an elongated recess extending a selected circumferential distance around the outer surface;

positioning at least one accessory member on the outer surface, the accessory member having a circumferential extent less than 360 degrees, inserting an inner portion of the accessory member inward into the recess, and sliding the accessory member along the recess to a selected angular position relative to the axis;

securing the accessory member in the recess at the selected angular position; and securing the clamp around the neck.

18. The method according to claim 17, wherein:

the recess comprises a dovetail groove extending a selected circumferential distance along the outer surface; and securing the accessory member comprises tightening the accessory member to the clamp with a fastener.

19. The method according to claim 17, wherein:

the recess has at least one wall surface facing inward toward the axis;

the inner portion of the accessory member comprises a retainer separate from an outer portion of the accessory member; and tightening a fastener between the outer portion of the accessory member and the retainer pulls the retainer outward into frictional engagement with the wall surface, thereby locking the accessory member in the selected angular position.

20. The method according to claim 17, wherein:

providing at least one auxiliary member comprises providing first and second auxiliary members; and the method further comprises:

inserting inner portions of the first and second accessory members into the recess and sliding the first and second accessory members relative to each other along the recess to selected angular position relative to the axis.

* * * * *